US005921845A

United States Patent [19]

Scholtz

[11] Patent Number: 5,921,845

[45] Date of Patent: Jul. 13, 1999

[54] BRASSIERE AND ACCESSORY

[76] Inventor: Wendy Scholtz, 2821 Anchor Ave., Los Angeles, Calif. 90064

[21] Appl. No.: 09/131,931

[22] Filed: Aug. 10, 1998

[51] Int. Cl.[6] ..... A41D 27/00; A41C 3/00; A41C 3/12

[52] U.S. Cl. ..... 450/86; 2/73

[58] Field of Search ..... 2/67, 73, 69, 69.5, 2/105, 106, 113, 114, 115, 300, 326, 327, 328, 329, 330, 331, 333, 334, 310, 315, 316, 317; 450/86, 88

[56] References Cited

U.S. PATENT DOCUMENTS

| | | | |
|---|---|---|---|
| 2,600,645 | 6/1952 | Harrington | 450/86 |
| 2,816,293 | 12/1957 | Graf | 450/88 |
| 2,870,768 | 1/1959 | Robinson | 450/86 |
| 3,077,885 | 2/1963 | Hopper | 450/86 |
| 3,179,109 | 4/1965 | Born | 450/86 |
| 3,207,898 | 9/1965 | Williams | 450/86 |
| 3,411,508 | 11/1968 | Sayers | 450/86 |
| 3,465,754 | 9/1969 | Lockwood et al. | 450/86 |
| 5,149,293 | 9/1992 | Gable | 450/86 |

*Primary Examiner*—Jeanette Chapman
*Attorney, Agent, or Firm*—Beehler & Pavitt

[57] ABSTRACT

An improved brassiere comprising a means for connecting a first point located on the back portion of a first shoulder strap to a second point located on a first lateral strap. The second point is located between the end of the first lateral strap and the juncture of the first shoulder strap and the first lateral strap. Also, the brassiere includes a means for connecting a third point located on the back portion of the second shoulder strap to a fourth point located on the second lateral strap. The fourth point is located between the end of the second lateral strap and the juncture of the second shoulder strap and the second lateral strap. The means for connecting the first and second points is a first strap having two ends with each end fixedly or removably attached to the first and second points. The means for connecting the third and fourth points is a second strap having two ends with each end fixedly or removably attached to the third and fourth points. The strap can be adjustable in length or elastic in order to conform to the size of the wearer. A detachable version of the straps can be sold separately as an accessory for use with other conventional brassieres by individuals desiring the same feature of the improved brassiere.

12 Claims, 3 Drawing Sheets

Fig. 5
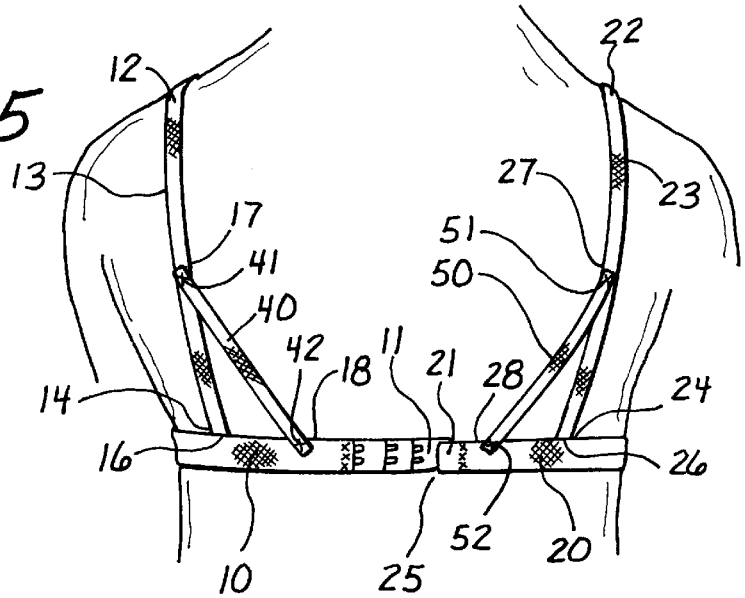
Fig. 6A
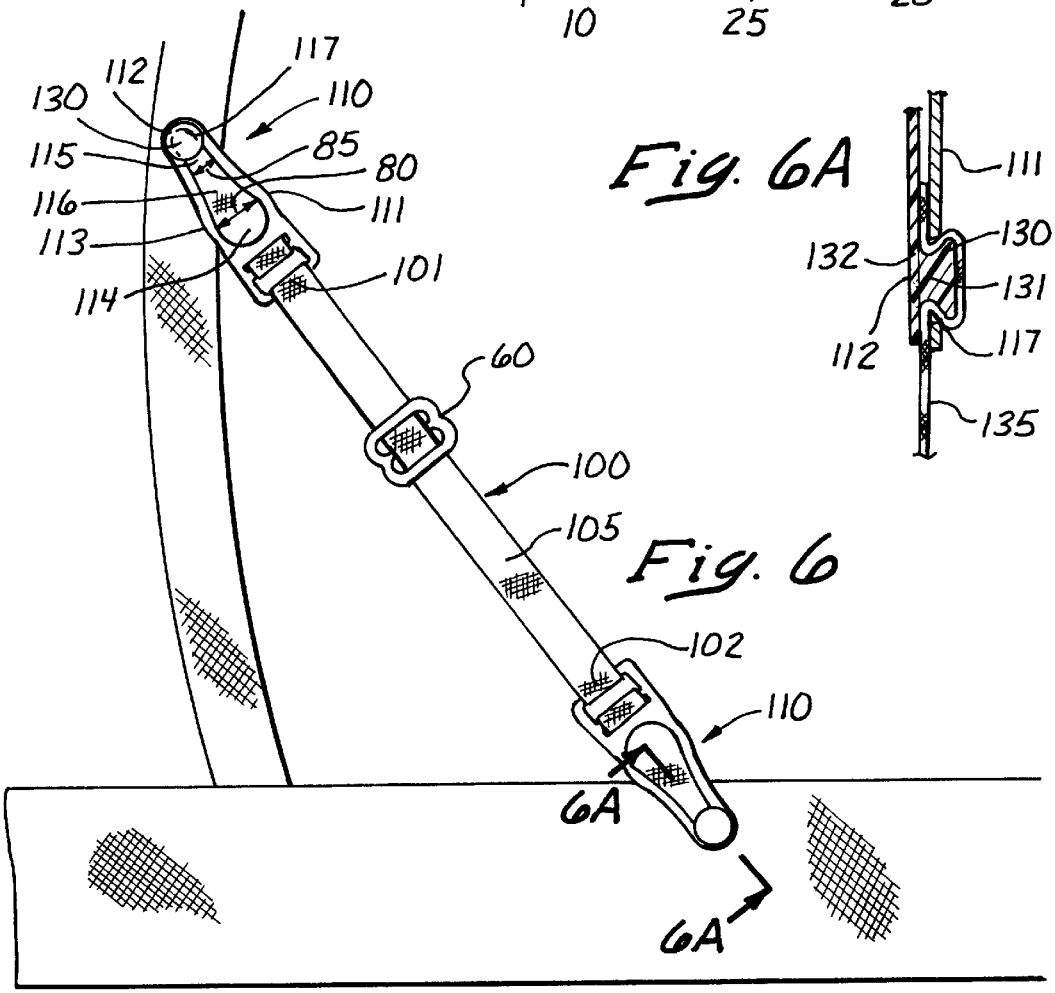
Fig. 6

BRASSIERE AND ACCESSORY

FIELD OF INVENTION

This invention relates to an improved brassiere (bra) and an accessory for a brassiere. More particularly this invention relates to an improved brassiere designed to prevent the shoulder straps from sliding off the wearer's shoulder with the improvement being a pair of specially positioned straps, which can also be made in a detachable form to be used as an accessory to perform the same function on other conventional brassieres.

BACKGROUND OF THE INVENTION

Conventional brassieres comprise generally a pair of support cups attached frontally to a band that encircles the chest. A pair of shoulder straps are attached to the top of the support cups and along the band located on the wearer's back. The shoulder straps on most brassieres do not cross each other at the wearer's back. Also, the shoulder straps, in order to comfortably fit the wearer, can be made to be adjustable, elastic, or both.

A problem with the conventional brassiere is that there is a tendency for the shoulder straps to slip off the wearer's shoulder. As the shoulder straps are tightened to attempt to solve this problem, there is a tendency for the straps, which are generally narrow, to dig into the wearer's shoulder causing significant discomfort and pain. The straps have been made wider and sometimes padded to allow the straps to fit tightly without digging into the shoulders, but these straps tend to show through the outer garment of the wearer and are avoided by many stylish wearers.

Various patents have been written disclosing inventions providing means to maintain the shoulder straps on the wearer's shoulders. U.S. Pat. No. 5,149,293 issued to Gable discloses an accessory comprising two elongated bands that can be fastened together at one end below the breasts, cross each other at the back, and slip onto the shoulder straps at the back by a gripping means at the second ends. Although this accessory maintains the shoulder straps on the shoulders, it may be uncomfortable for the wearer in that the portion of the band at the front of the wearer has a tendency to not stay in one place. When the band is tightened to attempt to keep the front section in one place, the band tends to dig into the skin. U.S. Pat. No. 4,612,935 issued to Griefer discloses a band to hold the straps together at the back or front. From the standpoint of utility, this accessory is too difficult for the wearer to attach alone.

There are other patents such as U.S. Pat. No. 5,643,043 issued to Pflum and U.S. Pat. No. 4,202,343 issued to Ichelson which are directed at new types of brassieres. Both improve the comfort of the bra, however, neither addresses the problem of keeping the shoulder straps comfortably on the shoulders.

Accordingly, it is the general objective of the instant invention to provide a new type of brassiere designed to prevent the shoulder straps from slipping off the wearer's shoulders while minimizing discomforting stress on the shoulders. It is also an objective of the present invention to make the new type of brassiere invisible under the clothing of the wearer. Another objective of the present invention is for the new brassiere to be easy and inexpensive to manufacture.

It is a further objective of the invention to provide an accessory adaptable to many conventional brassieres to prevent the shoulder straps from slipping off the wearer's shoulders while maintaining the comfort and appearance of the original brassiere.

SUMMARY OF THE INVENTION

This invention is directed to an improved brassiere having a pair of support cups, a first and second shoulder strap, and a first and second lateral strap each attached at one end to an outer lower point on the support cup and having a means of removable attachment to one another. This new brassiere includes a means for connecting a first point located on the back portion of the first shoulder strap to a second point located on the first lateral strap. The second point is spaced between the end of the first lateral strap and the juncture of the first shoulder strap and the first lateral strap. Also, the new brassiere includes a means for connecting a third point located on the back portion of the second shoulder strap to a fourth point located on the second lateral strap. The fourth point is spaced between the end of the second lateral strap and the juncture of the second shoulder strap and the second lateral strap.

The means for connecting the first and second points is a first connection strap having two ends with each end fixedly or removably attached to the first and second points. The means for connecting the third and fourth points is a second connection strap with two ends with each end fixedly or removably attached to the third and fourth points. The straps can be adjustable or elastic in order to conform to the size of the wearer.

Detachable embodiments of the connection straps in the form of strap modules can be sold separately as an accessory for use with other conventional brassieres by individuals desiring the same feature of the new brassiere. Each of the connection straps has a strapping member, a first connection end, and a second connection end opposite the first end. Each of the connection ends includes a means for removably attaching to one of the first, second, third and fourth points on the brassiere. The latter means can be a male and a female snap member, a VELCRO hooking member and a VELCRO loop member, a clasp of the type typically found on suspenders, or a garter-type clasp having a garter ring and a mating garter button. The strapping member can have a length adjustment means or be elastic, or both.

An appreciation of the other aims and objectives of the present invention and an understanding of it may be achieved by referring to the accompanying drawings and the detailed description of a preferred embodiment.

BRIEF DESCRIPTION OF THE DRAWINGS

FIG. 5 is a back view of an individual wearing an embodiment of the improved brassiere wherein the lateral straps removably connect at the back. The straps are fixedly secured to the attachment points;

FIG. 6 shows a strap having a means of length adjustment and capable of being removably attached to the attachment points with a garter-type clasp and a mating garter button; and FIG. 6A shows an elevational side view of a cross-section of brassiere fabric engaged by the garter-type clasp locking into the mating button.

DETAILED DESCRIPTION OF THE PREFERRED EMBODIMENT

Figure 1A:
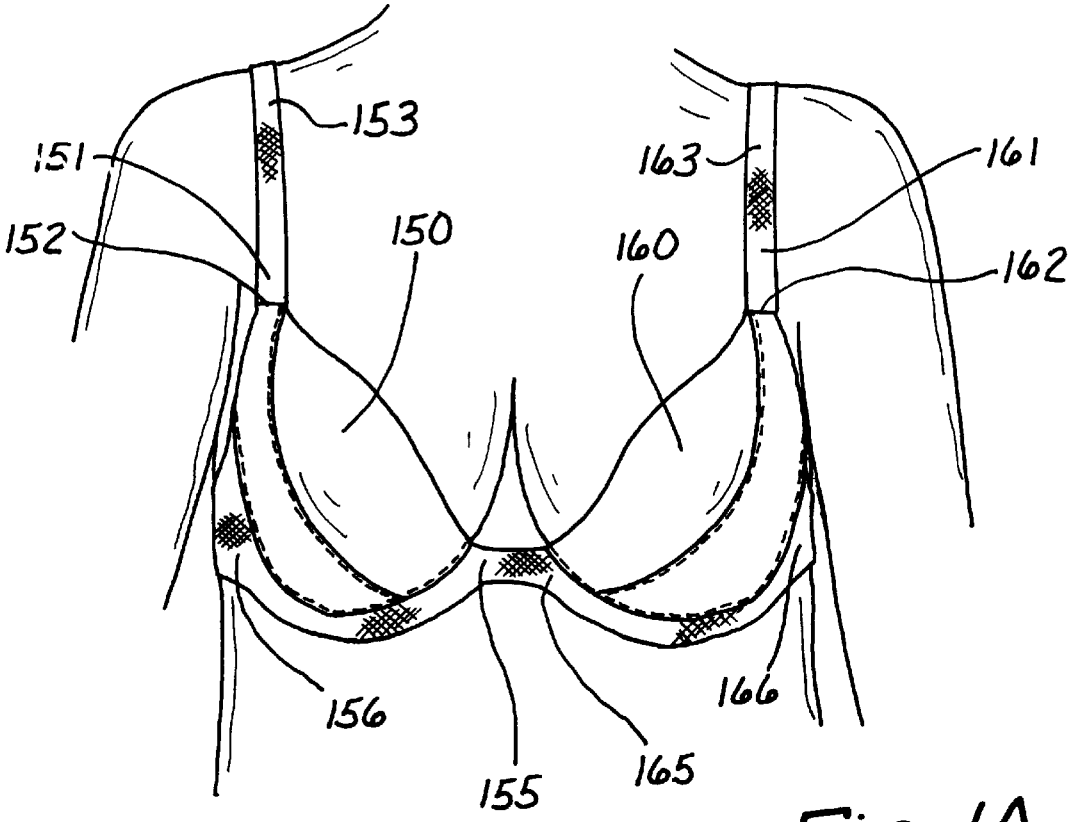
FIG. 1 is a back view of an individual wearing an improved brassiere with the straps fixedly secured to the attachment point.
Figure 1:
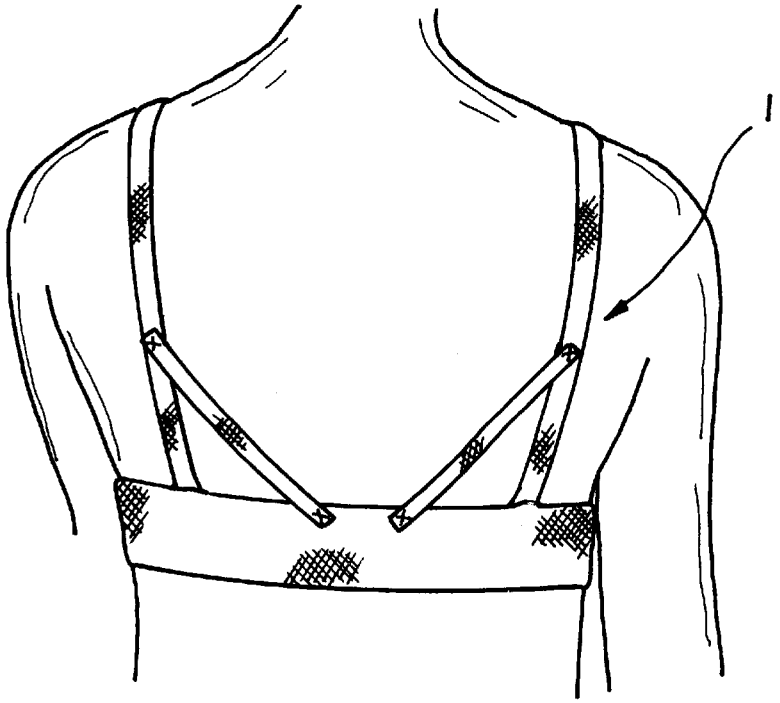
Figure 2:
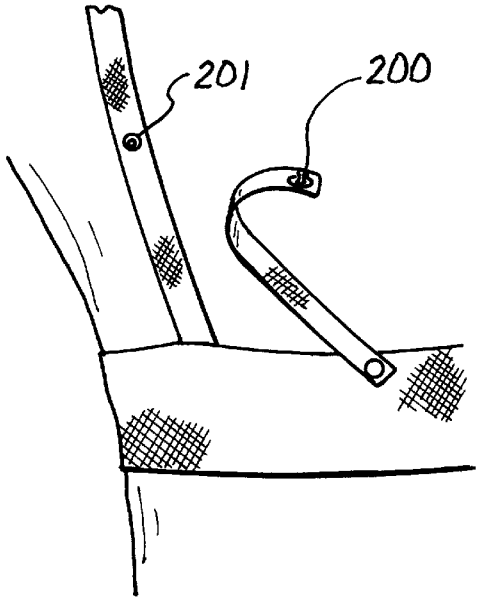
FIG. 2 shows an improved brassiere wherein the strap is removably attached to attachment points by means of a male and female snap.
Figure 3:
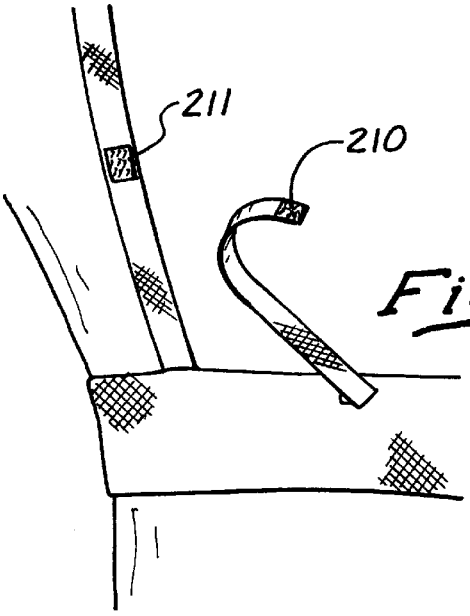
FIG. 3 shows an improved brassiere wherein the strap is removably attached to the attachment points by means of VELCRO hook and loop fasteners.
Figure 4:
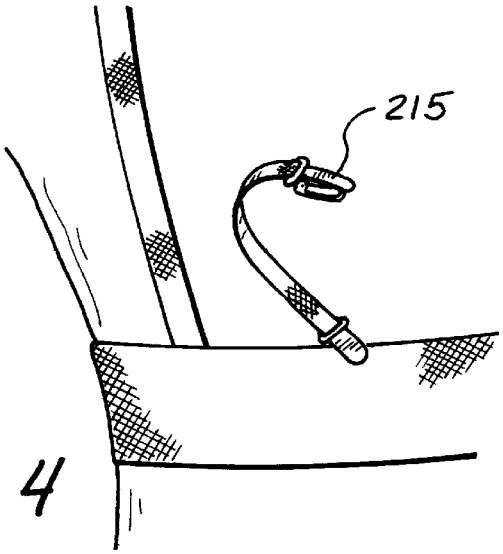
FIG. 4 shows a strap capable of being removably attached to the attachment points with clasps of the type typically found on suspenders.

The improved brassiere 1 is shown in FIGS. 1 through 6 and has a first and second support cups (not shown), each of the support cups has an inner and outer lower attachment point and an upper attachment point (not shown). A means is provided for connecting the first support cup to the second support cup at the inner lower attachment points. First 10 and second 20 lateral straps extend from the outer lower attachment points to an end 25. A means is provided for removably connecting the ends 11, 21 of the first 10 and second 20 lateral straps. The improved brassiere also has first 12 and second 22 shoulder straps. Each of the straps 12, 22 has a first end (not shown) fixedly attached to the upper attachment point of the support cup, a front portion (not shown) extending from the first end upwardly to the top of the shoulder of a wearer, and a back portion 13, 23 extending from the front portion downwardly to a second end 14, 24. The second end 14, 24 is fixedly attached to one of the lateral straps 10, 20 at a point 16, 26 spaced from the ends 11, 21 of the lateral strap. The improvement includes a means for connecting a first point 17, located on the back portion 13 of the first shoulder strap, to a second point 18, located on the first lateral strap 10. The second point 18 is spaced between the end 11 of the first lateral strap 10 and the juncture 16 of the first shoulder strap 12 and the first lateral strap 10. Also, the improvement includes a means for connecting a third point 27, located on the back portion 23 of the second shoulder strap 22, to a fourth point 28, located on the second lateral strap 20. The fourth point 28 is spaced between the end 21 of the second lateral strap and the juncture 26 of the second shoulder strap 22 and the second lateral strap 20.

In the preferred embodiment the means for connecting the first point 17 to the second point 18 is a first connection strap 40, and the means for connecting the third point 27 to the fourth point 28 is a second connection strap 50. Each of the straps 40, 50 has a first end 41, 51, a second end 42, 52. A means is provided for attaching each of the first ends 41, 51 to one of the first 17 and third 27 points, and a means is provided for attaching each of the second ends 42, 52 to one of the second 18 and fourth 28 points.

The connection straps 40, 50 can be elastic, include a means for length adjustment 60, or both in order to conform to the size of the wearer.

FIGS. 2, 3, 4, and 6 show detachable embodiments of the connection straps 40, 50 in the form of strap modules 100, which can be used as an accessory for a conventional bra with each strap 100 having a strapping member 105 of a first predetermined length 5, a first connection end 101, and a second connection end 102 opposite the first end 101. Each of the connection ends 101, 102 includes a means for removably attaching to one of the first 17, second 18, third 27, and fourth 28 points. The strapping member 105 can be elastic, have a length adjustment 60 means or both in order to conform to the various sizes of different bras and wearers.

In the preferred embodiment of the strap module 100, the means for removably attaching the first connection end 101 and the second connection end 102 to one of the first 17, second 18, third 27, and fourth 28 points is a pair of garter-type clasps 110 each having a garter ring 111 and a mating garter button 112. Each garter ring 111 is a continuous loop 113 of a semi-rigid material having a generally circular wide region 114 of a predetermined diameter 80 and a channel region 115 extending from the wide region 114. The channel region 115 has an opening 116 to the wide region 114 and a semi-circular end 117 opposite the wide region 114. The channel region 115 has a predetermined width 85 less than the diameter 80 of the wide region 114. Each garter ring 111 is fixedly attached to one end 101, 102 of the strapping member 105. FIG. 6A illustrates a mating garter button 112 having a head 130 shaped in a manner allowing the head 130, covered with a layer of bra material 135, to pass through the wide region 114 but not through the channel region 115. A body 131 is located below the head 130 and connected to the head 130. The body 131 is of a predetermined diameter (not shown) which allows the body 131, covered with a layer of bra material 135, to slide within the channel region 115 to the semi-circular end 117. A base member 132 attached below the body 131 is attached to the garter ring 111 adjacent the juncture of the garter ring 111 and the strapping member 105. The base member 132 is of a predetermined shape and size to prevent the button 112 from sliding through the channel region 115 of the garter ring 111.

There are other means for removably attaching the first connection end 101 and the second connection end 102 to one of the first 17, second 18, third 27, and fourth 28 points. One embodiment shown in FIG. 2 includes male 200 and female 201 snap members. Another embodiment shown in FIG. 3 includes a VELCRO hooking member 210 and a VELCRO loop member 211. Yet another embodiment shown in FIG. 4 includes a clasp 215 of the type typically found on suspenders.

I claim:

1. An improved bra, comprising:

first and second support cups, each of said support cups having inner and outer lower attachment points and an upper attachment point;

means for connecting the first support cup to the second support cup at the inner lower attachment points;

first and second lateral straps, each of said straps extending from the outer lower attachment points to an end;

means for removably connecting the ends of the first and second lateral straps;

first and second shoulder straps, each of said straps having a first end fixedly attached to the upper attachment point of the support cup, a front portion extending from the first end upwardly to the top of the shoulder of a wearer, a back portion extending from the front portion downwardly to a second end, said second end being fixedly attached to one of said lateral straps at a point spaced from the end thereof;

means for connecting a first point disposed upon the back portion of the first shoulder strap to a second point disposed upon the first lateral strap, said second point being spaced between the end of the first lateral strap and the juncture of the first shoulder strap and the first lateral strap; and means for connecting a third point disposed upon the back portion of the second shoulder strap to a fourth point disposed upon the second lateral strap, said fourth point being spaced between the end of the second lateral strap and the juncture of the second shoulder strap and the second lateral strap.

2. An improved bra as described in claim 1 wherein the means for connecting said first point to said second point is a first connection strap and the means for connecting said third point to said fourth point is a second connection strap, each of said straps comprising:

a first end and a second end;

means for attaching each of the first ends to one of the first and third points; and means for attaching each of the second ends to one of the second and fourth points.

3. An improved bra as described in claim 2 wherein said connection strap is elastic.

4. An improved bra as described in claim 2 wherein said connection strap further comprises a means for adjusting the length of said strap.

5. A pair of detachable strap modules for use with a bra, said bra having first and second support cups, each of said support cups having inner and outer lower attachment points and an upper attachment point, means for connecting the first support cup to the second support cup at the inner lower attachment points, first and second lateral straps, each of said straps extending from the outer lower attachment points to an end, means for removably connecting the ends of the first and second lateral straps, first and second shoulder straps, each of said straps having a first end fixedly attached to the upper attachment point of the support cup, a front portion extending from the first end upwardly to the top of the shoulder of a wearer, a back portion extending from the front portion downwardly to a second end, said second end being fixedly attached to one of said lateral straps at a point spaced from the end thereof; a first point disposed upon the back portion of the first shoulder strap, a third point disposed upon the back portion of the second shoulder strap, a second point disposed upon the first lateral strap, said second point being spaced between the end of the first lateral strap and the juncture of the first shoulder strap and the first lateral strap, a fourth point disposed upon the second lateral strap, said fourth point being spaced between the end of the second lateral strap and the juncture of the second shoulder strap and the second lateral strap, said pair of strap modules for connecting said first point to the second point and for connecting said third point to the fourth point, each of said strap modules comprising:

a strapping member of a first predetermined length, said strapping member having a first connection end and a second connection end opposite said first end, each of said connection ends including means for removably attaching to one of said first, second, third, and fourth points.

6. A detachable strap module as described in claim 5 wherein said strapping member is elastic.

7. A detachable strap module as described in claim 5 further comprising a means for adjusting the length of said strapping member.

8. A detachable strap module as described in claim 5 wherein said means for removably attaching said first connection end and said second connection end to one of said first, second, third, and fourth points includes a clip of the type typically found on suspenders.

9. A detachable strap module as described in claim 5 wherein said means for removably attaching said first connection end and said second connection end to one of said first, second, third, and fourth points includes male and female snap members.

10. A detachable strap module as described in claim 5 wherein said means for removably attaching said first connection end and said second connection end to one of said first, second, third, and fourth points includes a VELCRO hooking member and a VELCRO loop member.

11. A detachable strap module as described in claim 5 wherein said means for removably attaching said first connection end and said second connection end to one of said first, second, third, and fourth points includes a garter-type clasp having a garter ring and a mating garter button.

12. A detachable strap module as described in claim 5 wherein said means for removably attaching said first connection end and said second connection end to one of said first, second, third, and fourth points comprises:

a pair of garter rings, each of said garter rings being a continuous loop of a semi-rigid material having:

a generally circular wide region of a predetermined diameter, an opening leading from the wide region into a channel region extending from said wide region, said channel region of a predetermined width less than the diameter of said wide region ending in a semi-circular end opposite said wide region, each of said garter rings being fixedly attached to one end of said strapping member;

a mating garter button having:

a head shaped in a manner allowing said head, covered with a layer of bra material, to pass through the wide region but not through the channel region, a body disposed below the head and connected thereto, said body being of a predetermined diameter allowing said body, covered with a layer of bra material, to slide within the channel region to said semi-circular end; and a base member disposed below the body portion and connected thereto and attached to said garter ring adjacent the juncture of the garter ring and the strapping member, said base member being of a predetermined shape to prevent said button from sliding through the channel region of the garter clip.

* * * * *